US005827443A

United States Patent [19]

Kita et al.

[11] Patent Number: 5,827,443

[45] Date of Patent: Oct. 27, 1998

[54] WATER PERMEATING AGENT FOR TEXTILE PRODUCTS AND WATER PERMEABLE TEXTILE PRODUCTS

[75] Inventors: Setsuo Kita; Haruhiko Komeda, both of Nara-ken; Teruo Higashiguchi, Takaishi; Kazuhide Takahashi, Nara; Sumio Oota, Kashiwara, all of Japan

[73] Assignee: Matsumoto Yushi-Seiyaku Co., Ltd., Osaka, Japan

[21] Appl. No.: 821,971

[22] Filed: Mar. 14, 1997

Related U.S. Application Data

[63] Continuation-in-part of Ser. No. 672,051, Jun. 26, 1996, abandoned.

[30] Foreign Application Priority Data

Jun. 28, 1995 [JP] Japan ..... 7-161795

[51] Int. Cl.[6] ..... D06M 13/325

[52] U.S. Cl. ..... 252/8.61; 252/8.81; 428/283; 428/289

[58] Field of Search ..... 252/8.61, 8.81; 428/288, 289

[56] References Cited

U.S. PATENT DOCUMENTS

| | | | |
|---|---|---|---|
| 3,997,490 | 12/1976 | Matsuda et al. | 524/364 |
| 4,324,724 | 4/1982 | Mueller et al. | 528/422 |
| 4,943,612 | 7/1990 | Morita et al. | 524/714 |

FOREIGN PATENT DOCUMENTS

| | | |
|---|---|---|
| 54-153870 | 12/1979 | Japan . |
| 59-501049 | 6/1984 | Japan . |
| 51-15192 | 4/1986 | Japan . |
| 63-303184 | 12/1988 | Japan . |
| 20-80672 | 3/1990 | Japan . |

OTHER PUBLICATIONS

R.W. Moncrieff, "Man–Made Fibres", Sixth Exition, London Newness–Buttersworths, 1975, pp. 775–790 [month unknown].

Chemical Abstract No. 81:171252 which is an abstract of German Patent Specification No. 2,258,614 (Jun. 1974).

*Primary Examiner*—Anthony Green
*Attorney, Agent, or Firm*—Watson Cole Stevens Davis, P.L.L.C.

[57] ABSTRACT

The object of the present invention is to provide a water permeating agent, which imparts water permeability durable against repeated water permeation, and sufficient fiber cohesion to binder fibers, which are processed into textile products, such as nonwovens; said water permeating agent comprises a (poly)alkyl polyalkylenepolyamine amide and a trialkylglycine derivative.

2 Claims, No Drawings

WATER PERMEATING AGENT FOR TEXTILE PRODUCTS AND WATER PERMEABLE TEXTILE PRODUCTS

This application is a Continuation-in-Part of application Ser. No. 08/672,051, filed Jun. 26, 1996, now abandoned.

BACKGROUND OF THE INVENTION

The present invention relates to a water permeating agent, which remarkably improves the hydrophilicity of the textile products made of hydrophobic fibers, and imparts sufficient fiber cohesion and water permeability; and to water permeable textile products, to which the water permeating agent is applied.

Binder fibers have been employed in various fields owing to their specific physical properties and superior cost performance. Various nonwoven fabrics made of the binder fibers, of which major material is polyester fibers containing olefinic fiber, a highly hydrophobic fiber, are employed for the coverstocks of adult pads, baby diapers, or sanitary napkins. Because those coverstocks are expected to be free from wetting for achieving comfortable skin contact.

The strong hydrophobicity of the binder fibers mentioned above is apt to disturb easy water permeation through nonwovens, and keep the water on coverstock surface without being transferred into absorptives under coverstocks. Various methods have been introduced for improving the water permeability of the nonwoven fabrics of hydrophobic binder fibers. Those methods are (i) applying hydrophilic compounds to the surface of the textile products; (ii) applying graft-polymerizing hydrophilic compounds to the surface of the textile products; (iii) treating the textile products with a chemical solution or low-temperature plasma to form hydrophilic groups on the surface of the surface of the textile products; and (iv) adding hydrophilic compounds in fiber polymers.

The examples of the above method (i) are (a) treating polypropylene porous film with an anionic surfactant containing at least one of the bases selected among sulfate, phosphate, and sulfate bases (Japanese Patent Laid-Open No. 54-153872); (b) treating polypropylene microporous hydrophobic film with an organic solvent solution of a fatty acid sorbitane monoester (Japanese Patent Laid-Open No. 59-501049); (c) coating a polyolefin fiber with polyether-modified aminopolysiloxane (Japanese Patent Publication (Kokoku) No. 61-15192). The above methods improve the water permeability of the resultant nonwovens. But the nonwovens are not durable against repeated water permeation, and the hydrophilicity of the thermally bonded nonwovens of the said fibers and films is lower than the nonwovens processed without thermal treatment. Another example of the above method (i) is; (d) treating fibers with polyoxyalkylene-modified silicones and nonionic surfactants (Japanese Patent Laid-Open No. 63-303184 and No. 2-80672). The method results in insufficient entanglement and thermal bonding of the treated fiber, and requires considerable cost. Similar examples are also disclosed in U.S. Pat. No. 4,943,612 and U.S. Pat. No. 3,997,490. In U.S. Pat. No. 4,943,612, the copolymer latex of nitrogen compounds, such as alkylaminoacrylates or betaine esters, and glycidyl acrylate are claimed to give water-durable coating with high film-forming ability. And in U.S. Pat. No. 3,997,490, a compound obtained from the reaction of an amphoteric surfactant and a substance obtained from the reaction of polyurethaneurea polyamine and epichlorohydrine is claimed to improve the handle of nonwovens with improved coating performance. Both of the methods failed to impart satisfiable water permeability to the nonwovens employed for diapers and sanitary napkins. In addition, those polymer latexes coating nonwoven surface are apt to be scraped off due to abrasion on skin and to cause skin irritation.

The methods (ii) and (iii) are not sutable for mass production, require special devices, and fail to attain sufficient water permeability. In the method (iv), sufficient amount of hydrophilic compounds in fiber polymer for imparting water permeability lowers the productivity, and durability against heat or light of the resultant fibers. Thus, a satisfactory method for imparting durable water-permeability to nonwovens has not been developed yet.

Web-processing method for nonwoven fabrics has been remarkably developed recently, represented by wet process based on paper-making technology, and by dry process in which web is prepared with air flow or carding frames. Such development in web-processing has enabled to produce a high-quality web at extremely high speed. Various technical innovations in bonding binder fibers in web have also been attained. Those innovations include thermo-bonding web with meltable fibers of low-melting-point thermoplastic polymer, and bonding the web under hot press etc.

High speed web processing often faces electro-static troubles and insufficient fiber cohesion in web, which lead to poor web formation. In addition, poor processing performance of the fibers to be processed into web sometimes emerges as one of the troubles in web formation.

At present, binder fibers, which have superior antistaticity, cohesiveness, and processing performance for producing nonwovens of durable water permeability against repeated water permeation, cannot be produced in large scale.

SUMMARY OF THE INVENTION

The present invention provides a water permeating agent for textile products, the agent which can impart durable water permeability against repeated water permeation, superior antistaticity, and sufficient cohesiveness to the binder fibers to be processed into nonwovens.

The present invention also provides a water permeating agent, which imparts superior carding performance to the binder fibers to be processed into web for nonwoven fabrics.

DETAILED DESCRIPTION OF THE INVENTION

The present invention relates to a water permeating agent for textile product, comprising (a) a (poly)alkyl polyalkylenepolyamine amide and/or its alkylene oxide adducts, and (b) a trialkylglycine derivative and/or alkyl imidazolium hydroxyethyl glycine derivatives; and the textile products processed with the binder fibers applied with the said water permeating agent.

The phrase "binder fibers" is illustrated in "MAN-MADE FIBRES Sixth Edition" by R. W. Moncrieff, LONDON NEWNES-BUTTERWORTHS, 1975, PAGE 775–790, the entire disclosure of which is herein incorporated by reference. The term "binder fibers" is also known as "thermoplastic binder fibers" or "weldable fibers" as noted by page 789, lines 15–16 of the above mentioned MAN-MADE FIBRES, Sixth Edition. The entire disclosure of the above-mentioned MAN-MADE FIBRES, is herein expressly incorporated by reference.

The (poly)alkyl polyalkylenepolyamine amide of the present invention is a condensate of one or more of fatty acids having 12 or more carbon atoms and selected among monovalent saturated or unsaturated fatty acids (such as lauric acid, myristic acid, palmitic acid, stearic acid, behenic acid, oleic acid, and linoleic acid), divalent saturated or unsaturated fatty acid (such as maleic acid, and adipic acid), and monovalent or divalent aromatic carboxylic acid (such as benzoic acid, and phthalic acid); and polyalkylene polyamines. Preferable acids for the condensation are monovalent saturated or unsaturated fatty acids such as lauric acid, myristic acid, palmitic acid, stearic acid, behenic acid, oleic acid, and linoleic acid. And palmitic acid, stearic acid, adipic acid, phthalic acid, and succinic acid are especially preferable in cost.

The said polyalkylene polyamines to be condensed with the said acids are the compounds wherein 2 to 6 amine groups are bonded to an alkylene group having 2 to 6 carbon atoms. The said alkylene group may include substituents, such as alkoxy groups (e.g., methoxy, and propoxy groups). The said polyalkylene polyamines comprise one or more polyamines selected among diethylenetriamine, ethylenediamine, triethylenetetraamine, polyethoxydiethylenetriamine, polypropoxy diethylenetriamine, aminoethylamine ethanol amine, dimethylaminoethylamine, and dihydroxyethylamine. The preferable polyalkylenepolyamines are aminoethylamine ethanol amine, dimethylaminoethylamine, and diethylenetriamine.

The (poly)alkyl polyalkylenepolyamine amide can be obtained by condensing the said acids with the said polyalkylenepolyamines. The molar ratio of the carboxyl groups of the said acids to the amine groups of the said polyalkylenepolyamine should not necessarily be controlled into the ratio, at which all amine groups are converted into amide groups. Some of the amine groups introduced in the condensation may be remained without being alkanoylated. The preferable molar ratio of the carboxyl groups to the amine groups is from 1:1 to 1:2. The preferable (poly)alkyl polyalkylenepolyamine amides for attaining superior water permeability are the alkylene oxide adducts, having polyoxyalkylene group, wherein the activated hydrogen of amino and amide groups is reacted with alkylene oxides. The preferable molar ratio of the alkylene oxide to the amino and amide groups in the said addition reaction is from 10:1 to 100:1.

The trialkylglycine derivative constituting the water permeating agent of the present invention is an internal salt of a quaternary ammonium salt obtained by bonding three alkyl groups to a nitrogen atom in the glycine molecular structure and the anion of carboxyl groups. And thus the internal salt has betaine in its molecular structure. The alkyl groups to be bonded to the nitrogen atom mentioned above are selected among those having 1 to 22 carbon atoms. The said trialkylglycine derivatives are the internal salts, such as dimethyldodecylglycine hydroxide, dimethyltetradecylglycine hydroxide, dimethyloctadecylglycine hydroxide, heptadecylimidazolium hydroxyethylglycine hydroxide, and the like. Among those, the internal salts having two lower alkyl groups, such as methyl and ethyl groups, and one long-chain alkyl group having 12 or more carbon atoms, such as heptadecylimidazolium hydroxyethylglycine hydroxide, and β-hydroxyoctadecyl dimethylglycine hydroxide, are preferred.

The amount of trialkylglycine derivative, alkyl imidazolium hydroxyethyl glycine derivative and mixtures thereof (component (b)) is 0.2 to 5 parts by weight based on one part by weight of the polyalkylpolyamine amide its alkylene oxide adducts and mixtures thereof (component (a)).

The preferred weight ratio of the (poly)alkyl polyalkylenepolyamine amide to the trialkylglycine derivative in the water permeating agent of the present invention is 1 part of the (poly)alkyl polyalkylenepolyamine amide to 1 or more parts of the trialkylglycine derivative; preferably 1 part of the (poly)alkyl polyalkylenepolyamine amide to 2 or more parts of the trialkylglycine derivative.

The water permeating agent of the present invention may include additives such as, antistatic agents (e.g., sodium dioxyethylene dodecylphosphate), nonionic emulsifiers, and lubricants (e.g., carnauba wax), for optimizing the property and performance of the fibers and textile products applied with the water permeating agent.

The preferable textile products to be applied with the water permeating agent of the present invention include hydrophobic fibers to be processed into textile products, and the textile products comprising the hydrophobic fibers. The hydrophobic fibers are polyolefin fiber, fibrillated polyolefin fiber, and the core-sheath bicomponent fibers of the combinations of polyester/polyethylene, polyester/polypropylene, polyethylene/polypropylene, copolypropylene/polypropylene, copolyester/polypropylene, and copolyester/polyester.

The preferable ratio of water permeating agent of the present invention to binder fibers is 0.1 to 2.0 weight percent, preferably from 0.3 to 0.7 weight percent. The ratio lower than 0.1 weight percent cannot attain sufficient and durable water permeability. On the other hand, the ratio higher than 2.0 weight percent results in excessive wraps on card cylinder leading to poor web processing efficiency, or reduces the water permeability of resultant textile products so as to make them wetty after water permeation.

The water permeating agent of the present invention is applied to fibers being emulsified in 5 to 30 percent by weight in water, or being dissolved in 5 to 30 percent by weight in low-viscosity mineral oil. The finish-application device is a kiss-roll or an oiling nozzle and metering-pump applicator. Both immersion and spray are also employable for finish application.

The water permeating agent of the present invention can be applied not only to polyolefin fiber and fibrillated polyolefin fiber, but also to polyester fiber, nylon fiber, vinyl chloride fiber, and the bicomponent fibers thereof.

The water permeating agent of the present invention remarkably improves the durability of the water permeability of textile products against repeated water permeation. The agent also improves the cohesiveness of binder fibers during web formation, and minimizes electro-static charge and wraps on card cylinders in carding process leading to remarkably improved productivity. Such performance improves web and fabric formation.

The binder fibers applied with the water permeating agent of the present invention, the web consisting of the binder fibers and their combination with other fiber variants, and the nonwoven fabrics consisting of one or more of the webs maintain excellent water permeability after repeated water permeation. The nonwoven fabrics of the above-mentioned fibers can be formed in spun-bond, spun-lace, and melt brow systems, also.

The water permeability imparted with the water permeating agent of the present invention is not deteriorated throughout thermal fusing and bonding processes of nonwoven production. And the resultant nonwoven fabrics also have sufficient water permeability durable against repeated water permeation. The fiber cohesion and thermal bonding performance of the binder fibers applied with the water permeating agent of the present invention are much superior to those of fibers applied with the agents of which major component is silicone.

The water permeating agent of the present invention provides binder fibers, which have sufficient water permeability, disperse well in water in the wet forming process, and can be processed into light-weight web and nonwovens, of which density is 20 g/m$^2$ or less. And the nonwoven fabrics of the fibers are processed into comfortable coverstocks for baby diapers and sanitary napkins, and garments, such as underwears, owing to their superior water permeability durable against repeated water permeation.

The present invention provides water permeable textile products of the binder fibers, to which the water permeating agent comprising (a) a (poly)alkyl polyalkylenepolyamine amide, and (b) a trialkylglycine derivative is applied. The textile products mentioned herein include not only final products, such as underwears, made of the fibers applied with the water permeating agent of the present invention, but also the binder fibers applied with the water permeating agent, and the web and nonwovens of the binder fibers.

The following Examples provide detailed description of the present invention.

EXAMPLE 1

An aqueous emulsion of a water permeating agent was prepared by mixing 30 parts by weight of the condensate of aminoethylamine ethanol amine (1.0 mole) and stearic acid (2.0 moles) reacted in a four-necked flask equipped with a stirrer as purging the air with nitrogen gas; 70 parts by weight of an internal salt of heptadecylimidazolium hydroxyethylglycine hydroxide represented by the following formula,

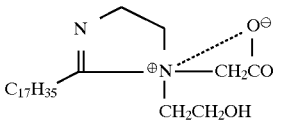

; and 900 parts by weight of water. The prepared emulsion was applied to a polypropylene fiber in 5 percent of fiber weight, wherein the ratio of the components to fiber was 0.5 weight percent. Then the polypropylene fiber was dried.

The resultant fiber was fed to scutchering and high-speed carding to be processed into web of 20 g/m$^2$. In the carding, static electricity generated at 20° C. (40% RH), wraps on the card cylinder, and web formation were inspected to evaluate the processing performance of the fiber. The result was ranked as follows.

Static Electricity Generated in Carding

5: 0.5 kv or less
4: 0.5 kv to 1.0 kv
3: 1.0 kv to 1.5 kv
2: 1.5 kv to 2.0 kv
1: 2.0 kv or more

Wraps on Card Cylinder

5: no wraps
4: wraps covering 1/10 of cylinder surface
3: wraps covering 1/5 of cylinder surface
2: wraps covering 1/3 of cylinder surface
1: wraps covering whole of cylinder surface

Web Formation

5: formed tight and uniform
4: formed tight though swinged
3: formed tight but nonuniform
2: formed loose and partially sagged
1: partially broken The amount of the static electricity was 0.2 kv, and no wraps on the card cylinder were found. The resultant web was sufficiently tight, and did not sag.

The web was then thermally bonded at 136° C. to be formed into nonwoven fabric. A drop of water was placed on the surface of the nonwoven to test the time required for water drop to permeate into the nonwoven, and the permeating behavior, both of which represent the water permeability into the nonwoven.

Water-Permeability Testing

A drop of water was placed on tightened dry nonwoven. The time required for the water drop to be spread into the nonwoven was measured, and the state of the spreading was observed. The result was ranked as follows.

5: immediately disappeared without wetty handle on nonwoven surface
4: disappeared within 10 seconds without wetty handle on nonwoven surface
3: disappeared in 10 to 30 seconds without wetty handle on nonwoven surface
2: disappeared in 30 to 60 seconds with wetty handle on nonwoven surface where the water drop was placed
1: remained over 60 seconds leaving wetty handle on nonwoven surface The water drop permeated immediately into the nonwoven, and the permeating behavior was also satisfiable, without leaving wetty handle on the surface.

This nonwoven was then dipped in water for 30 minutes, dehydrated with a centrifugal separator, and dried to be tested on the durability of the water permeability against repeated water permeation. A drop of water was placed on the surface of the nonwoven again, and the time required for the water drop to permeate into the nonwoven, and the permeating behavior were tested. The water drop permeated immediately, and the permeating behavior was satisfiable without leaving wetty handle on the surface.

EXAMPLE 2

An aqueous emulsion of a water permeating agent was prepared by mixing 45 parts by weight of a condensate of condensing diethylenetriamine (1.0 mol) and behenic acid (2.5 moles) reacted in a four-necked flask equipped with a stirrer as purging air with nitrogen gas; 40 parts by weight of an internal salt of heptadecylimidazolium hydroxyethylglycine hydroxide; 15 parts by weight of sodium dioxyethylene dodecylphosphate; and 900 parts by weight of water. The prepared emulsion was applied to a polypropylene fiber in the same manner as in Example 1, and the fiber was dried. The prepared fiber sample was tested as in the same manner in Example 1.

In the carding at 20° C. (40% RH), the amount of static electricity generated was 0.3 kv. No wraps on the card cylinder were found. And the resultant web was sufficiently tight, and did not sag.

The web of 20 g/m$^2$ was then thermally bonded at 136° C. to be formed into nonwoven fabric. A drop of water was placed on the surface of the nonwoven to test the time required for the water drop to permeate into the nonwoven and the permeating behavior. The water drop permeated immediately, and the permeating behavior was satisfiable without wetty handle on the surface.

The nonwoven was dipped in water, dehydrated, and dried as in the same manner in Example 1. The durability of the water permeability of the nonwoven against repeated water permeation was tested in the same manner as in Example 1. The water drop placed on the nonwoven permeated immediately, and the permeating behavior was satisfiable without leaving wetty handle on the nonwoven surface.

EXAMPLE 3

The aqueous emulsion of the water permeating agent of Example 1 was applied to a spun-bonded nonwoven fabric of a polypropylene fiber in 10 percent of fiber weight, wherein the ratio of the components to fiber was 1.0 weight percent, and the nonwoven fabric was dried. The water drop placed on the nonwoven permeated into the nonwoven with satisfiable permeating behavior leaving no wetty handle on the nonwoven surface. And the durability against repeated water permeation was satisfiable like as mentioned in Example 1.

EXAMPLE 4

An aqueous emulsion of a water permeating agent was prepared by mixing 45 parts by weight of a component, obtained by adding ethylene oxide (21.0 moles) to the condensate of diethylenetriamine (1.0 mole) and behenic acid (2.0 moles) reacted in a four-necked flask equipped with a stirrer as purging air with nitrogen gas; 40 parts by weight of an internal salt of dimethyloctadecylglycine hydroxide; 15 parts by weight of sodium dodecylphosphate; and 900 parts by weight of water. The emulsion was applied to a polyester-polyethylene core-sheath bicomponent fiber in 5 percent of fiber weight, wherein the ratio of the components to the fiber was 0.5 weight percent. The amount of static electricity generated in the carding at 20° C. (40% RH) was 0.3 kv, and no wraps on the card cylinder was found. The resultant web was sufficiently tight without sagging. A drop of water was placed on the nonwoven fabric, of which density was 20 g/m$^2$. The water drop permeated immediately with satisfiable permeating behavior, leaving no wetty handle on the nonwoven fabric surface. The nonwoven fabric was then tested on the durability against repeated water permeation as described in Example 1, and was found to have satisfiable water permeability as well as that in the initial water permeation test.

EXAMPLE 5

Five percent by weight of the aqueous emulsion of the water permeating agent of Example 4 was applied to a polyester staple fiber (1.2 denier, 10 mm), and the fiber was dried. The polyester staple fiber dispersed in water homogeneously with little foaming. A wet nonwoven can be prepared from the polyester fiber dispersion.

EXAMPLE 6

An aqueous emulsion of a water permeating agent was prepared by mixing 40 parts by weight of a condensate (of which average molecular weight was 7000) of 2 moles of ethylene-oxide adduct of diethylenetriamine wherein the molar ratio of ethylene-oxide to diethylenetriamine was 25 to 1, and 1.8 moles of adipic acid reacted in a four-necked flask equipped with a stirrer as purging air with nitrogen gas; 40 parts by weight of an internal salt of dimethyloctadecylglycine hydroxide; 20 parts by weight of potassium dodecylphosphate; and 900 parts by weight of water. The emulsion was applied to the same variant of polypropylene fiber tested in Example 1, and the fiber was dried and tested in the same manner as in Example 1. The amount of static electricity generated in the carding at 20° C. (40% RH) was 0.1 kv, and no wraps on the card cylinder were observed. The resultant web was sufficiently tight without sagging. The resultant web, of which density was 20 g/m$^2$, was thermally bonded at 136° C. to be formed into nonwoven fabric. A drop of water was placed on the surface of the nonwoven fabric. The water drop permeated immediately with sufficient permeating behavior leaving no wetty handle on the nonwoven surface. The nonwoven fabric was then tested on the durability against repeated water permeation as described in Example 1, and was found to have satisfiable water permeability as well as that in the initial water permeation test.

EXAMPLE 7

An aqueous emulsion of a water permeating agent was prepared in the same manner as in Example 6, except that adipic acid in the condensation was replaced by isophthalic acid. The emulsion was applied to the same polypropylene fiber variant in Example 6, and the fiber was tested in the same manner as in Example 6. The amount of static electricity generated in the carding at 20° C. (40% RH) was 0.2 kv, and no wraps on card cylinder were found. The resultant web was sufficiently tight without sagging. Then the web was formed into nonwoven fabric in the same manner as in Example 6. Then the nonwoven fabric was tested on the water permeability, and on the durability of the water permeability against repeated water permeation in the same manner, and gave satisfiable result as in the foregoing Examples.

EXAMPLE 8

An aqueous emulsion of a water permeating agent was prepared by mixing 30 parts by weight of a condensate of dimethylaminoethylamine (1.0 mole) and behenic acid (1.0 mole) reacted in a four-necked flask equipped with a stirrer as purging air with nitrogen gas; 30 parts by weight of an internal salt of β-hydroxyoctadecyl dimethylglycine hydroxide; 40 parts by weight of sodium tetraoxyethylene dodecylsulfate; and 900 parts by weight of water. The emulsion was applied to a polypropylene fiber, the same variant tested in Example 1, and the fiber was tested in the same manner as in Example 1. The amount of static electricity generated in the carding at 20° C. (40% RH) was 0.6 kv, and no wraps on the card cylinder were found. The resultant web was sufficiently tight without sagging. Then the web, of which density was 20 g/m$^2$, was thermally bonded at 136° C. to be formed into nonwoven fabric. A drop of water was placed on the surface of the nonwoven fabric, and the time required for the water drop to permeate into the nonwoven, and the permeation behavior were tested. The water drop permeated immediately with satisfiable permeation behavior, leaving no wetty handle on nonwoven surface. Then the durability of the water permeability of the nonwoven fabric against repeated water permeation was tested in the same manner as in the foregoing Examples. The water permeability of the nonwoven in the test was also satisfiable as well as the initial permeation test.

EXAMPLE 9

An aqueous emulsion of a water permeating agent was prepared by mixing 25 parts by weight of a condensate of dimethylaminoethylamine (1.0 mole) and stearic acid (1.0 mole) reacted in a four-necked flask equipped with a stirrer as purging air with nitrogen gas; 35 parts by weight of an internal salt of β-hydroxyoctadecyl dimethylglycine hydroxide; 15 parts by weight of trioxyethylenetetradecyl ether; 25 parts by weight of potassium dioxyethylene dodecylphosphate; and 900 parts by weight of water. The emulsion was applied to a polypropylene fiber, the same variant as in Example 1 and the fiber was dried and tested as in Example 1. The amount of static electricity generated in the carding at 20° C. (40% RH) was 0.3 kv, and no wraps on the card cylinder were found. The resultant web was sufficiently tight without sagging. Then the web, of which density was 20 g/m$^2$, was thermally bonded at 136° C. to be formed into nonwoven fabric. A drop of water was placed on the nonwoven surface, and the time required for the water drop to permeate into the nonwoven, and the permeating behavior were tested. The water drop permeated into the nonwoven immediately with satisfiable permeation behavior, leaving no wetty handle on the nonwoven surface. Then the durability of the water permeability of the nonwoven against repeated water permeation was tested. The water drop placed on the nonwoven again permeated immediately with satisfiable permeating behavior leaving no wetty handle on the surface.

EXAMPLE 10, 11

An aqueous emulsion of a water permeating agent was prepared by mixing; 35 parts by weight of an ethylene oxide adduct of an amide (wherein the molar ratio of ethylene oxide to the amide was 15 to 1), the amide, which was a condensate of diethylene triamine (1.0 mol) and stearic acid (2.0 mols) reacted in a four-necked flask equipped with a stirrer as purging air with nitrogen gas; 35 parts by weight of the internal salt of dimethyloctadecyl glycine hydroxide; 30 parts by weight of potassium dioxyethylene dodecylphosphate and 900 parts by weight of water. The emulsion was applied to a core-sheath bicomponent fiber of polyethylene and polypropylene in the same manner as in Example 1, and the fiber was tested in the same manner as in Example 1. The static electricity generated in the carding at 20° C. (40% RH) was 0.1 kv. The resultant web was sufficiently tight. Then the web was thermally bonded to be formed into nonwoven fabric, of which density was 20 g/m$^2$. A drop of water placed on the surface of the nonwoven permeated immediately without diffusion leaving no wetty handle on the surface. The same result was obtained in the durability testing against repeated water permeation. The above fiber could be processed in high speed carding to be formed into web, of which density was 15 g/m$^2$, and then thermally bonded into nonwoven fabric (Example 11).

COMPARATIVE EXAMPLE 1

An aqueous emulsion of a water permeating agent was prepared by mixing 100 parts by weight of an internal salt of heptadecylimidazolium hydroxyethylglycine hydroxide, and 900 parts by weight of water. The emulsion was applied to the same variant of fiber tested in Example 1, and tested in the same manner as in Example 1. The resultant web was loose. A water drop placed on the nonwoven fabric processed from the web permeated immediately at the first stage of the water permeation test, though the nonwoven surface was wetty in one portion after the water permeation. And in the subsequent durability testing against repeated water permeation, a water drop on the nonwoven fabric remained over 120 seconds until permeating into the nonwoven, and wetty handle was found at several points of the nonwoven.

COMPARATIVE EXAMPLE 2

An aqueous emulsion of a water permeating agent was prepared by mixing 100 parts by weight of the ethylene oxide adduct of an amide (a condensate of diethylene triamine and stearic acid) applied in Example 10, and 900 parts by weight of water. And the performance of the emulsion was tested as in the same manner in Example 1.

COMPARATIVE EXAMPLE 3

According to Example 7 of Japanese Patent Laid-Open No. 2-80672, an aqueous emulsion of a water permeating agent was prepared by mixing 35 parts by weight of polyoxyalkylene-modified silicone (Si-7), 30 parts by weight of POE(2) stearyl aminolaurate, 35 parts by weight of stearic acid diethanolamide, and 900 parts by weight of water. And the performance of the emulsion was tested as in the same manner in Example 1. The carding performance of the fiber applied with the emulsion was poor. And the nonwoven fabric of the web processed with thermal bonding did not satisfiably recover its form and dimension after repeated elongation.

The above results were evaluated according to methods aforementioned and shown in Table 1.

TABLE 1

| | Examples | | | | | | | | | | Comp. Examples | | |
|---|---|---|---|---|---|---|---|---|---|---|---|---|---|
| Example No. | 1 | 2 | 3 | 4 | 6 | 7 | 8 | 9 | 10 | 11 | 1 | 2 | 3 |
| Static electricity | 5 | 5 | | 5 | 5 | 5 | 4 | 5 | 5 | 5 | 4 | 1 | 4 |
| Wraps on card cylinder | 5 | 5 | | 5 | 5 | 5 | 5 | 5 | 5 | 5 | 4 | 1 | 5 |
| Web tightness | 5 | 5 | | 5 | 5 | 5 | 5 | 5 | 5 | 5 | 2 | 1 | 3 |
| Water permeability | 5 | 5 | 5 | 5 | 5 | 5 | 5 | 5 | 5 | 5 | 2 | 1 | 5 |
| Durability against repeated water permeation* | 5 | 5 | 5 | 5 | 5 | 5 | 5 | 5 | 5 | 5 | 1 | 1 | 5 |

*ranked in the same manner as water permeability

The present invention provides a novel water permeating agent for textile products.

The textile products applied with the water permeating agent of the present invention has an excellent water permeability, and a durability against repeated water permeation.

The binder fibers applied with the water permeating agent of the present invention have sufficient antistaticity, cohesiveness, and superior processability in carding.

What we claim is:

1. A water permeating agent for textile product, comprising (a) at least one member selected from the group consisting of a polyalkylpolyamine amide, its alkylene oxide adducts and mixtures thereof, and (b) at least one member selected from the group consisting of a trialkylglycine derivative, alkyl imidazolium hydroxyethyl glycine derivatives and mixtures thereof, wherein component (b) is present in an amount of 0.2 to 5 parts per weight based on one part by weight of component (a).

2. A water permeable textile product made of binder fibers, to which a water permeating agent comprising (a) at least one member selected from the group consisting of a polyalkylpolyamine amide, its alkylene oxide adducts and mixtures thereof, and (b) at least one member selected from the group consisting of a trialkylglycine derivative, alkyl imidazolium hdroxyethyl glycine derivatives and mixtures thereof, wherein component (b) is present in an amount of 0.2 to 5 parts per weight based on one part by weight of component (a), is applied, and wherein the ratio of water permeating agent to binder fibers being 0.1 to 2.0 weight percent.

* * * * *